US007710014B2

(12) United States Patent
Lee et al.

(10) Patent No.: US 7,710,014 B2
(45) Date of Patent: May 4, 2010

(54) ELECTRON EMISSION DEVICE, ELECTRON EMISSION DISPLAY DEVICE USING THE SAME AND METHOD OF MANUFACTURING THE SAME

(75) Inventors: Sang-Jo Lee, Kyunggi-do (KR); Chun-Gyoo Lee, Kyunggi-do (KR); Sang-Ho Jeon, Kyunggi-do (KR); Sang-Hyuck Ahn, Kyunggi-do (KR); Su-Bong Hong, Kyunggi-do (KR); Kyung-Sun Ryu, ChoongchungNam-do (KR); Jong-Hoon Shin, Kyunggi-do (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 783 days.

(21) Appl. No.: 11/390,263

(22) Filed: Mar. 28, 2006

(65) Prior Publication Data

US 2006/0220527 A1 Oct. 5, 2006

(30) Foreign Application Priority Data

Mar. 31, 2005 (KR) ..... 10-2005-0027053
Aug. 26, 2005 (KR) ..... 10-2005-0078751
Oct. 24, 2005 (KR) ..... 10-2005-0100192

(51) Int. Cl.
*H01J 1/62* (2006.01)

(52) U.S. Cl. ..... 313/497; 313/495; 313/496; 445/24

(58) Field of Classification Search ..... 313/495–497; 445/24
See application file for complete search history.

(56) References Cited

U.S. PATENT DOCUMENTS

| | | | | |
|---|---|---|---|---|
| 6,313,043 | B1 * | 11/2001 | Hattori | 438/745 |
| 2003/0001477 | A1 * | 1/2003 | Sasaguri | 313/310 |
| 2003/0113450 | A1 * | 6/2003 | Park et al. | 427/255.28 |
| 2005/0057168 | A1 * | 3/2005 | Song et al. | 315/111.81 |
| 2006/0022575 | A1 * | 2/2006 | Ryu et al. | 313/495 |
| 2006/0022577 | A1 * | 2/2006 | Kim | 313/497 |
| 2006/0208628 | A1 * | 9/2006 | Lee | 313/497 |

* cited by examiner

*Primary Examiner*—Toan Ton
*Assistant Examiner*—Bumsuk Won
(74) *Attorney, Agent, or Firm*—Lee & Morse, P.C.

(57) ABSTRACT

An electron emission device includes a substrate, a plurality of cathode electrodes formed on the substrate, a plurality of electron emission regions electrically coupled to the cathode electrodes, an insulating layer formed on the substrate while covering the cathode electrodes, and a plurality of gate electrodes formed on the insulating layer and crossing the cathode electrodes. The insulating layer is provided with a plurality of openings exposing the corresponding electron emission regions, each of the openings having at least two opening portions that communicate with each other and are different in a size from each other. The gate electrodes are provided with openings communicating with the corresponding openings of the insulating layer. The two opening portions may include a gap in the insulating layer where the gate and cathode electrodes interesect.

25 Claims, 11 Drawing Sheets

ELECTRON EMISSION DEVICE, ELECTRON EMISSION DISPLAY DEVICE USING THE SAME AND METHOD OF MANUFACTURING THE SAME

BACKGROUND OF THE INVENTION

1. Field of the Invention

The present invention relates to an electron emission device. More particularly, the present invention relates to an electron emission device that can suppress signal distortion by reducing the parasitic capacitance generated between cathode and gate electrodes while maintaining the emission property of an electron emission region, a method of manufacturing the electron emission device and an electron emission display using the electron emission device.

2. Description of the Related Art

Generally, electron emission elements are classified into those using hot cathodes as an electron emission source and those using cold cathodes as the electron emission source. There are several types of cold cathode electron emission elements, including Field Emitter Array (FEA) elements, Surface-Conduction Emitter (SCE) elements, Metal-Insulator-Metal (MIM) elements and Metal-Insulator-Semiconductor (MIS) elements.

The electron emission elements may be arrayed on a substrate to form an electron emission device. The electron emission device may be associated with another substrate, on which a light emission unit having a phosphor layer, a black layer and an anode electrode are formed to make an electron emission display.

A FEA element may include electron emission regions and a pair of driving electrodes. The electron emission regions may be formed of a material having a relatively low work function or a relatively large aspect ratio, such as a carbonaceous material or a nanometer-size material, so that electrons can be effectively emitted when an electric field is applied thereto under a vacuum state.

A typical electron emission device using FEA elements includes a substrate on which cathode electrodes, an insulating layer and gate electrodes are successively formed. Openings may be formed through the gate electrodes and insulating layer at crossed regions of the cathode and gate electrodes, thereby partly exposing the surfaces of the cathode electrodes. The electron emission regions are formed on the cathode electrodes in positions corresponding to the openings.

A scan signal voltage is applied to one of the cathode and gate electrodes and a data signal voltage is applied to the other of the cathode and gate electrodes. When the scan and data signal voltages are applied, an electric field is formed around an electron emission region of a pixel, and where a voltage difference between the cathode and gate electrodes is higher than a threshold value, electrons are emitted from the electron emission region.

With the above-described structure, the cathode electrodes and the gate electrodes intersect each other with an insulating layer interposed therebetween. The insulating layer is generally formed of a material having a dielectric constant of about twelve. Therefore, relatively high parasitic capacitance is generated at the crossed regions of the cathode and gate electrodes.

Thus, when the electron emission display is driven by the driving signals applied to the cathode and gate electrodes, signal distortion, e.g., retardation of the driving signal, may occur due to the parasitic capacitance. Under certain circumstance, gray scale display may not be realized.

The openings in the insulating layer are formed through a wet etching process. However, due to the inherent isotropic etching property of the wet etching process, a width of the opening is gradually enlarged as the etching process progresses. Thus, when the insulating layer has the same etch characteristics therethrough, the openings are narrower at the bottom than at the top thereof. Therefore, a distance between the electron emission region and the gate electrode increases. This increased distance reduces the intensity of the electric field formed around the electron emission region, thereby deteriorating the emission property of the electron emission region.

In order to reduce the distance between the electron emission regions and the gate electrodes, a thickness of the insulating layer must be reduced. However, when the thickness of the insulating layer is reduced, the parasitic capacitance at the crossed regions further increases. Moreover, since the electron emission regions are easily affected by the anode electrodes, a diode emission phenomenon where electrons are emitted by the anode voltage may occur.

SUMMARY OF THE INVENTION

The present invention is therefore directed to an electron emission device, a display device incorporating the same and a method of manufacturing the same, which substantially overcome one or more of the problems due to the limitations and disadvantages of the related art.

It is therefore a feature of an embodiment of the present invention to provide an electron emission device that inhibits signal distortion by reducing the parasitic capacitance generated at the crossed regions of cathode and gate electrodes, a method of manufacturing the electron emission device and an electron emission display using the electron emission device.

It is therefore another feature of an embodiment of the present invention to provide an electron emission device that can improve the emission property of an electron emission region by reducing a distance between the electron emission region and the gate electrode, a method of manufacturing the electron emission device and an electron emission display using the electron emission device.

At least one of the above and other features and advantages of the present invention may be realized by providing an electron emission device including a substrate, a plurality of cathode electrodes formed on the substrate, a plurality of electron emission regions electrically coupled to the cathode electrodes, an insulating layer formed on the substrate and covering the cathode electrodes, and a plurality of gate electrodes formed on the insulating layer and crossing the cathode electrodes, wherein the insulating layer includes a plurality of openings exposing corresponding electron emission regions, each opening having at least two opening portions in communication with each other and having different sizes from each other, and the gate electrodes include openings in communication with corresponding openings of the insulating layer.

Each opening of the insulating layer may include an upper opening portion having a first width and a lower opening portion having a second width, the second width being greater than the first width. The second width may be equal to or greater than a width of the cathode electrode. An area of the lower opening portion may be equal to or greater than an area of a crossing region of the gate and cathode electrodes. The gate electrodes may extend to inner walls of the upper opening portion. A width of the upper opening portion may gradually decrease toward the substrate and a width of the lower opening portion may gradually increase toward the substrate.

The insulating layer may include a first layer having the upper openings and a second layer having the lower openings, the first layer having a higher density than the second layer.

At least one of the above and other features and advantages of the present invention may be realized by providing a method of manufacturing an electron emission device, including forming a plurality of cathode electrodes on a substrate, forming an insulating layer on the substrate, forming a plurality of openings in the insulating layer, each opening of the insulating layer having upper and lower opening portions, forming a plurality of gate electrodes on the insulating layer, the gate electrodes having openings communicating with corresponding opening of the insulating layer, and forming a plurality of electron emission regions on the cathode electrodes inside the lower opening portions of the insulating layer.

Forming the plurality of gate electrodes may be performed before forming the plurality of opening in the insulating layer. The method may further include forming a plurality of openings in the gate electrode and sequentially etching the insulating layer through the openings of the gate electrode.

The method may further include, before forming the insulating layer, forming a sacrificial layer on each cathode electrode, wherein the sacrificial layer has an etching rate higher than that of the insulating layer, each opening on the gate electrode has a width less than a width of the sacrificial layer, and each opening of the insulating layer being formed by sequentially etching the insulating layer and the sacrificial layer through the openings of the gate electrodes. A width of the sacrificial layer may be equal to or greater than a width of the corresponding cathode electrode.

The insulating layer may have upper and lower portions, the upper portion having a higher density than the lower portion. Forming the insulating layer may include depositing the insulating material and increasing a deposition temperature used during forming of the upper portion from that during forming of the lower portion.

The method may include providing a mask layer having a plurality of openings on the insulating layer, wherein forming the plurality of openings in the insulating layer includes etching the insulating layer through the openings of the mask layer, and forming the plurality of gate electrodes includes forming gate electrodes on a top surface of the insulating layer and inner walls of the upper openings.

The lower opening portion has a width greater than a width of the upper opening portion. Forming the upper and lower opening portions may include wet etching the insulating layer such that the width of the upper opening portion gradually decreases toward the substrate and the width of the lower opening portion gradually increases toward the substrate.

At least one of the above and other features and advantages of the present invention may be realized by providing an electron emission display, including first and second substrates facing each other and spaced apart from each other having a plurality of phosphor layers formed on the second substrate and an anode electrode formed on one surface of the phosphor layers, and electron emission devices on the first substrate.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
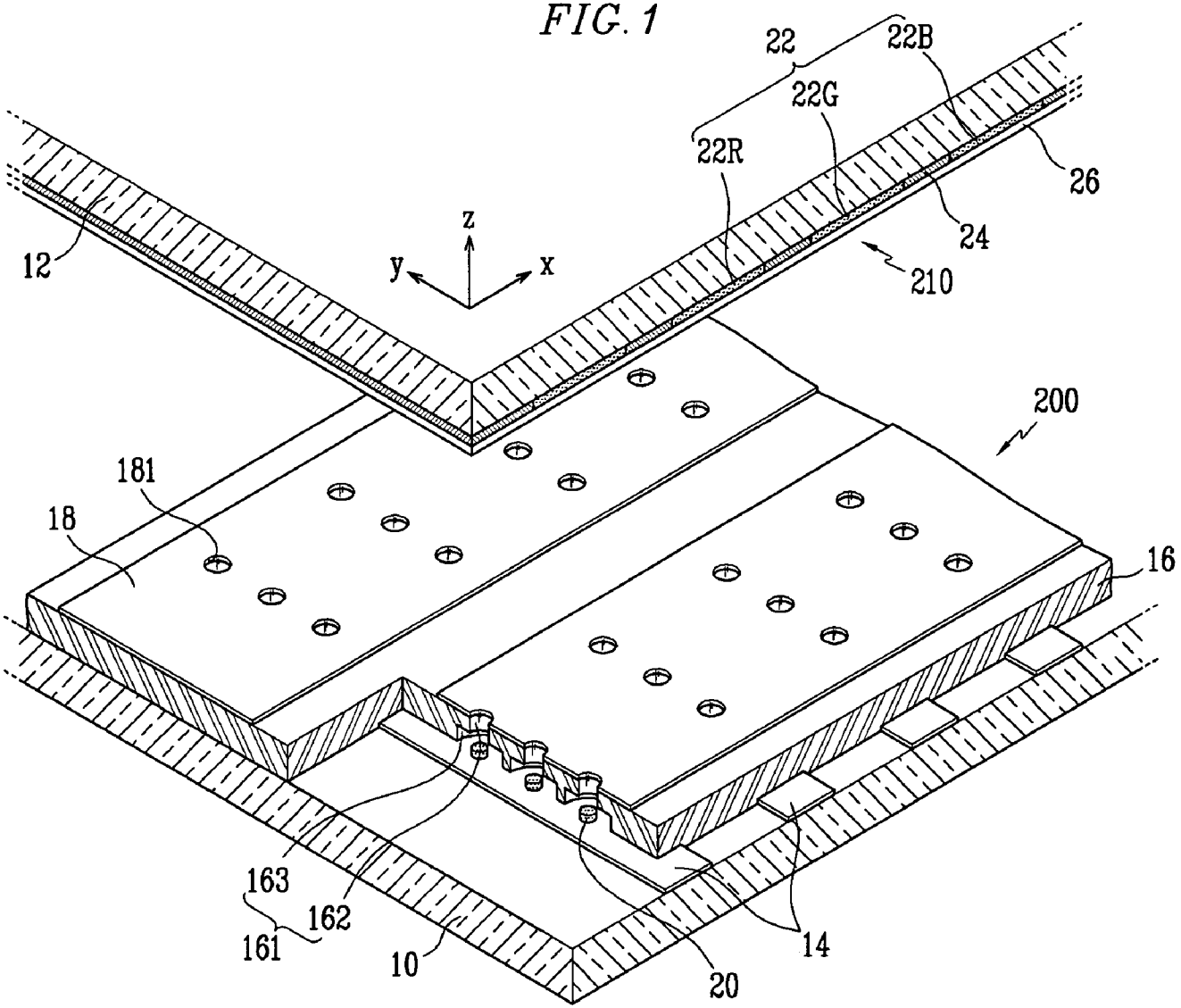
FIG. 1 illustrates a partial exploded perspective view of an electron emission display according to an embodiment of the present invention.

Korean Patent Application Nos. 10-2005-0027053, filed on Mar. 31, 2005, 10-2005-0078751, filed on Aug. 26, 2005, and 10-2005-0100192, filed on Oct. 24, 2005, in the Korean Intellectual Property Office, all of which are entitled "Electron Emission Device and Method of Manufacturing the Same," are incorporated by reference herein their entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
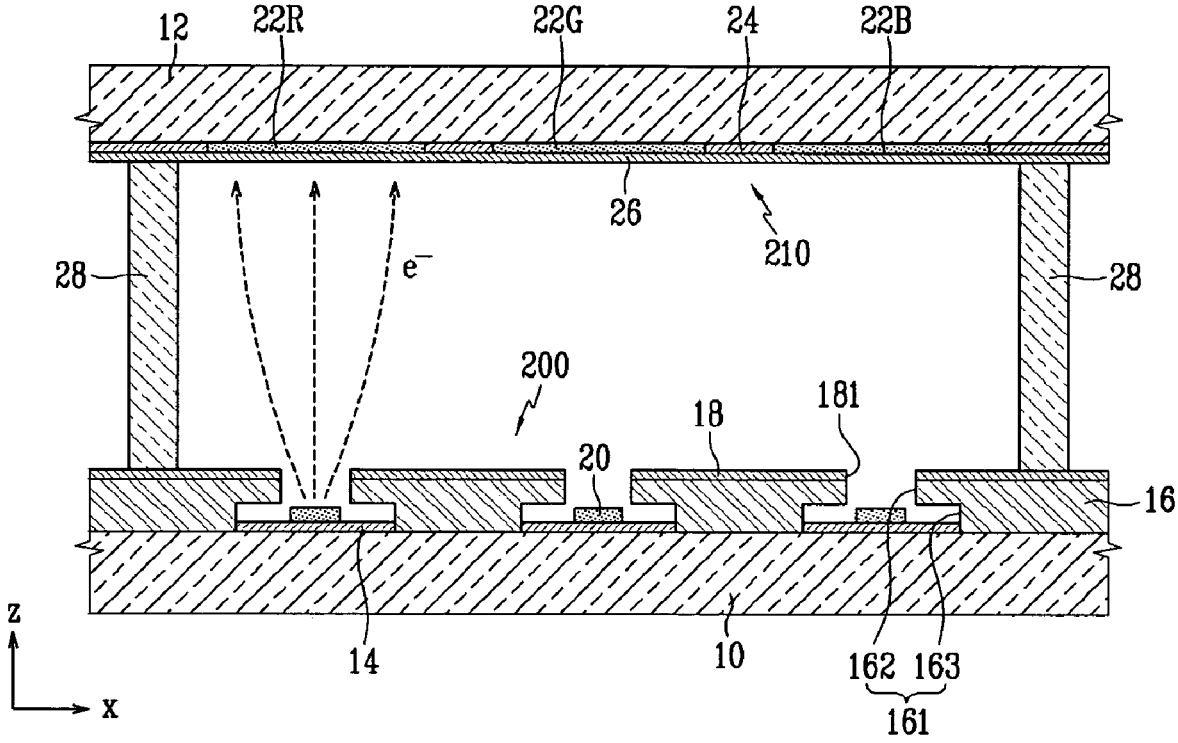
FIG. 2 illustrates a partial cross-sectional view of the electron emission display of FIG. 1.

FIGS. 1 and 2 illustrate an electron emission display according to an embodiment of the present invention. As shown therein, the electron emission display includes an electron emission device 200 and a light emission unit 210. The electron emission device 200 and the light emission unit 210 respectively have first and second substrates 10 and 12 facing each other and spaced apart by a predetermined distance.

A sealing member (not shown) may be provided at the peripheries of the first and the second substrates 10 and 12 to seal them together, thereby forming a vacuum vessel with the first and the second substrates 10 and 12 and the sealing member. The interior of the vacuum vessel may be kept to a degree of vacuum of about $10^{-6}$ torr.

A plurality of electron emission elements may be arrayed on a first surface of the first substrate 10 opposite to the second substrate 12, i.e., within the vacuum vessel.

Describing the electron emission device 200 in more detail, first electrodes 14, e.g., cathode electrodes, may be formed on the first substrate 10 and an insulating layer 16 may be formed on the first substrate 10 to fully cover the cathode electrodes 14. Second electrodes 18, e.g., gate electrodes, may be formed on the insulating layer 16 and may intersect the cathode electrodes 14, e.g., at right angles.

Crossed regions of the cathode electrodes 14 and the gate electrodes 18 may define pixel regions. Each pixel region may have a plurality of electron emission regions 20. Openings 161 and 181 corresponding to the electron emission regions 20 may be formed through the insulating layer 16 and the gate electrodes 18 to expose the electron emission regions 20.

The electron emission regions 20 may be formed of a material emitting electrons when an electric field is applied thereto under a vacuum atmosphere, such as a carbonaceous material or a nanometer-sized material. For example, the electron emission regions 20 can be formed of carbon nanotubes, graphite, graphite nanofibers, diamonds, diamond-like carbon, $C_{60}$, silicon nanowires, or a combination thereof. The electron emission regions 20 can be formed through any appropriate process, e.g., a screen-printing process, a chemical vapor deposition process, a direct growth process, or a sputtering process.

The electron emission regions 20 may be arranged in series in a longitudinal direction of one of the cathode and gate electrodes 14 and 18 (shown arranged along the cathode electrode 14 in FIG. 1) at each pixel region. Each electron emission region 20 and each opening 181 of the gate electrodes 18 are shown as being circular, but any appropriate shape may be used.

In this embodiment, each opening 161 of the insulating layer 16 may have at least two opening portions that are in communication with each other and have different widths. That is, each opening 161 may have an upper opening portion 162 and a lower opening portion 163, the lower opening portion 163 extending downward from the upper opening portion 162 and having a width greater than that of the upper opening portion 162.

The upper opening portion 162 may have a width greater than that of the corresponding electron emission region 20. The lower opening portion 163 may have a width equal to or greater than that of the cathode electrode 14. The upper and lower opening portions 162 and 163 and the corresponding electron emission region 20 may have a common central axis. The opening 181 of the gate electrode 18 may have a width identical to that of the corresponding upper opening portion 162.

With the above-described structure of the openings 161 formed on the insulating layer 16, an area of the crossed regions of the cathode electrodes 14 and the gate electrodes 18 with the insulating layer 16 interposed therebetween can be reduced. Moreover, although the width of the lower opening portions 163 increases, a distance between the gate electrodes 18 and the electron emission regions 20 may be maintained.

Phosphor layers 22 each having red (R), green (G) and blue (B) phosphors 22R, 22G and 22B may be formed on a surface of the second substrate 12 opposite to the first substrate 10, and black layers 24 may be arranged between the R, G and B phosphors 22R, 22G and 22B. Each crossed region of the cathode and gate electrodes 14 and 18 may correspond to a single color phosphor.

An anode electrode 26 formed of a metallic material, e.g., aluminum, may be formed on the phosphor and black layers 22 and 24. The anode electrode 26 may increase the screen luminance by receiving a high voltage required for accelerating the electron beams and reflecting the visible light emitted from the phosphor layer 22 to the first substrate 10 toward the second substrate 12.

Alternatively, the anode electrode can be formed of a transparent conductive material, e.g., as Indium Tin Oxide (ITO), instead of the metallic material. In this case, the anode electrode may be placed on the second substrate 12 and the phosphor and black layers 22 and 24 may be formed on the anode electrode.

Alternatively, the anode electrode can be made of both a metallic layer and a transparent conductive layer.

As shown in FIG. 2, spacers 28 may be disposed between the first and second substrates 10 and 12. The spacers 28 may uniformly maintain a gap between the first and second substrates 10 and 12 when an external force is applied. The spacers 28 may be arranged on the black layers 24.

The above-described electron emission display may be driven when a predetermined voltage is applied to the cathode, gate and anode electrodes 14, 18 and 26, respectively.

For example, one of the cathode and gate electrodes 14 and 18 may serve as a scan electrode receiving a scan drive voltage and the other may serve as a data electrode receiving a data drive voltage. The anode electrode 26 may receive a direct current voltage, e.g., hundreds to thousands of volts, which can accelerate the electron beams.

When a voltage difference between the cathode and gate electrodes 14 and 18 is equal to or higher than a threshold value, electrons are emitted from the electron emission regions 20. The emitted electrons strike the phosphor layers 22 of the corresponding pixel due to the high voltage applied to the anode electrode 26, thereby exciting the phosphor layers 22.

In this embodiment, since the area of the crossed regions of the cathode electrode 14 and the gate electrode 18 having the insulating layer 16 interposed therebetween is reduced, the parasitic capacitance caused by the insulating layer 16 is reduced. That is, according the present invention, a portion of the insulating layer is replaced by a gap (or, more accurately, a vacuum gap) between the cathode electrode 14 and the gate electrode 18 in an intersection thereof, effectively reducing the parasitic capacitance. As a result, signal distortion can be suppressed. Moreover, since the distance between the gate electrodes 18 and the electron emission regions 20 are closely maintained, the emission property of the electron emission regions 20 is not deteriorated.

Figure 3:
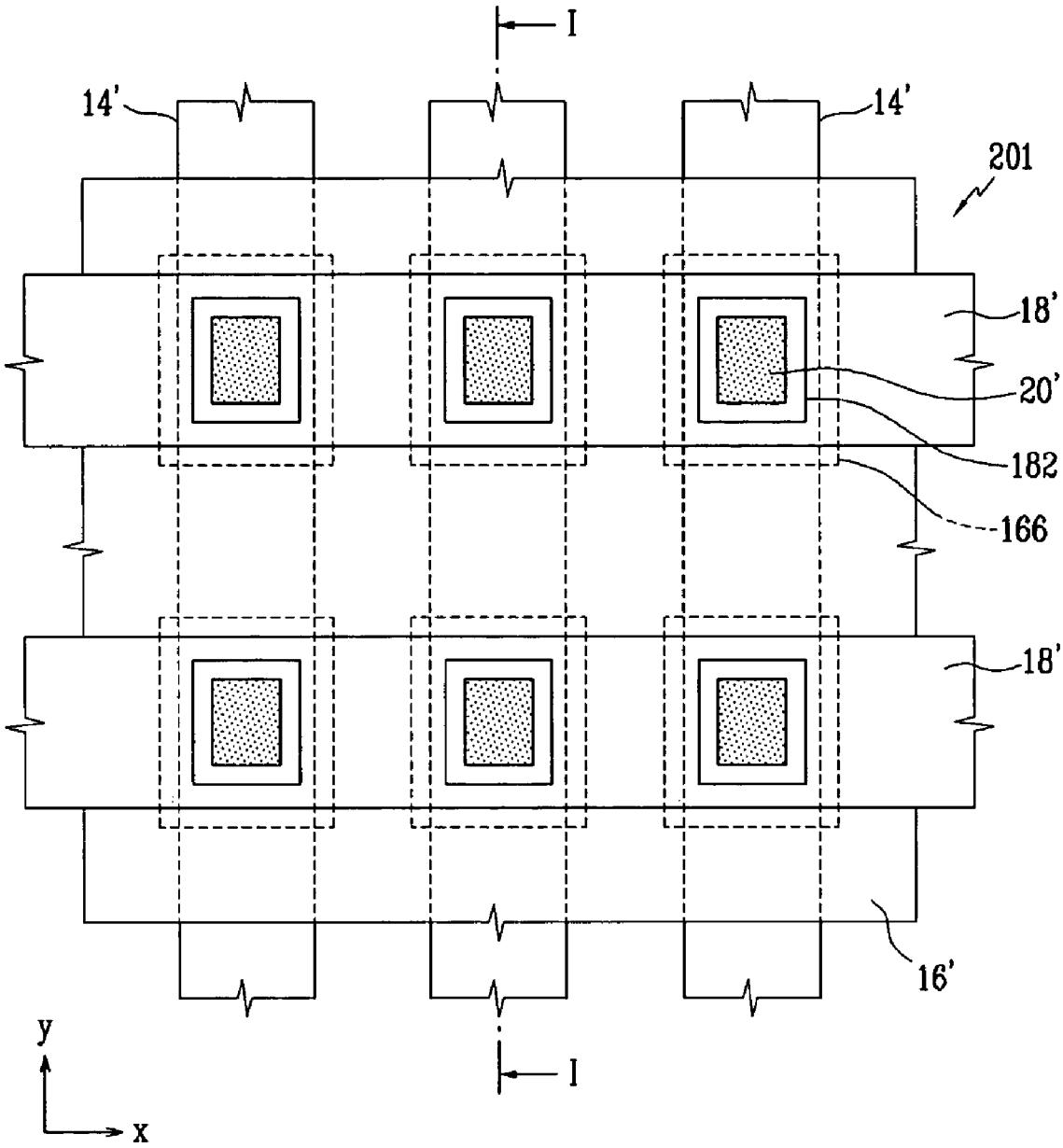
FIG. 3 illustrates a partial top view of an electron emission device of an electron emission display according to another embodiment of the present invention.
Figure 4:
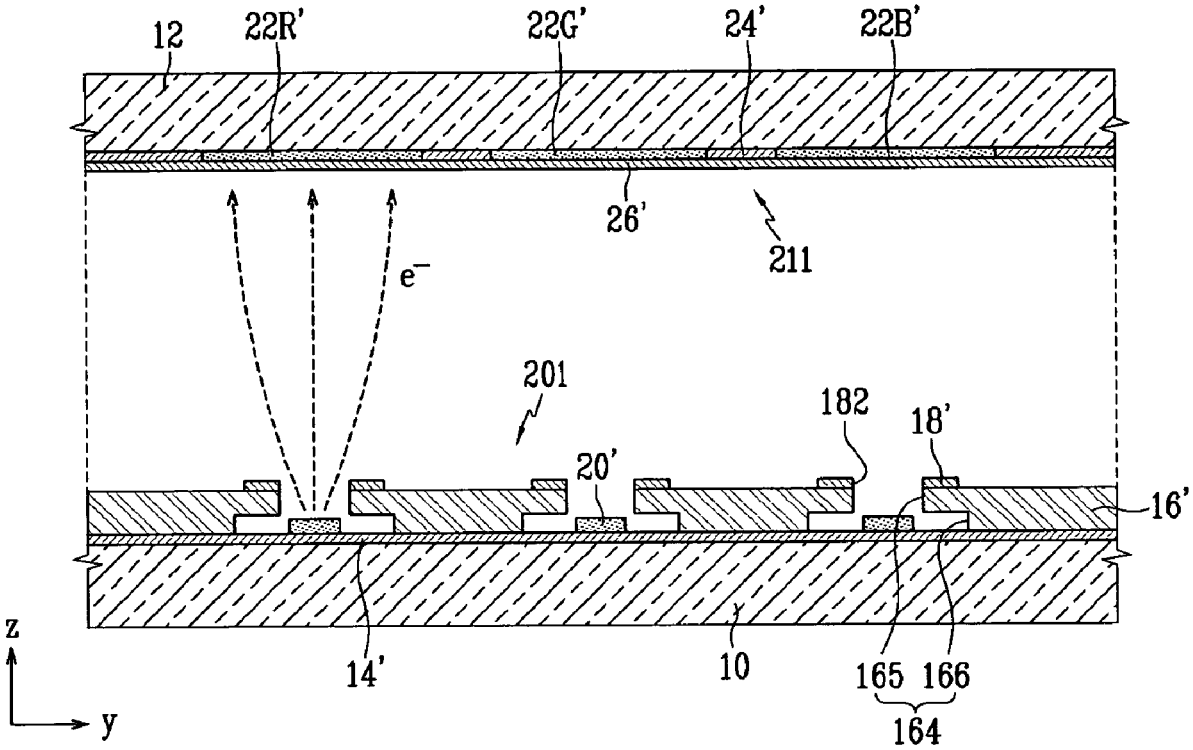
FIG. 4 illustrates a sectional view taken along ling I-I of FIG. 3.

FIGS. 3 and 4 illustrate an electron emission device of an electron emission display according to another embodiment of the present invention.

In this embodiment, each crossed region of cathode and gate electrodes 14' and 18' is provided with only one electron emission region 20'. Therefore, single openings 182 and 164 are formed at each crossed region through a gate electrode 18' and an insulating layer 16', respectively, to expose the corresponding electron emission region 20'.

In this embodiment, the opening 164 of the insulating layer 16' has an upper opening portion 165 and a lower opening portion 166 extending downward from the upper opening portion 165 and having a width greater than that of the upper opening portion 165. The width of the lower opening portion 166 may be equal to or greater than that of the corresponding crossed region.

In other words, a width of the lower opening portion 166 measured along a width of the cathode electrode 14' may be equal to or greater than the width of the cathode electrode 14', and a width of the lower opening portion 166 measured along a width of the gate electrode 18' may be equal to or greater than the width of the gate electrode 18'. Thus, an area of the lower opening portion 166 may be equal to or greater than an area of the corresponding crossed region.

When the sectional area of the lower opening portions 166 is equal to or greater than the area of the corresponding crossed region, an area of the crossed region of the cathode and gate electrodes 14' and 18' having the insulating layer 16' interposed therebetween is substantially eliminated. In other words, a portion between the cathode and gate electrodes 14' and 18' at the corresponding crossed region is simply a vacuum. Therefore, the parasitic capacitance between the cathode and gate electrodes 14' and 18' can be minimized and signal distortion can be more effectively suppressed.

In FIG. 3, the openings 182 of the gate electrode 18' and the electron emission regions 20' are shown as being rectangular. However, the present invention is not limited to this, and any appropriate opening shape may be used.

FIGS. 5A through 5E illustrate cross-sectional views of stages in a method of manufacturing the electron emission devices of FIGS. 1 and 3.

Figure 5A:
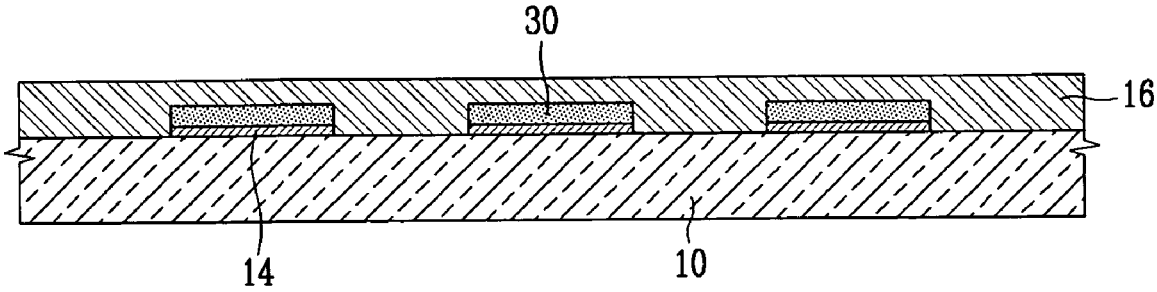
FIGS. 5A through 5E illustrate cross-sectional views of stages in a method of manufacturing the electron emission devices of FIGS. 1 and 3.

Referring first to FIG. 5A, a conductive layer may be formed on the first substrate 10 and the cathode electrodes 14 may be formed by patterning the conductive layer. Sacrificial layers 30 may be formed on the cathode electrodes 14 at locations where electron emission regions will be formed. A width of each sacrificial layer 30 may be equal to or greater than that of the corresponding cathode electrode 14. An insulating layer 16 may be deposited on the first substrate 10 to fully cover the sacrificial layers 30.

The insulating layer 16 may be formed of a material having an etching rate lower than that of the sacrificial layer 30. Since a surface of the insulating layer 16 may be uneven due to the sacrificial layer 30, a surface flattening process may be further performed after the insulating material is deposited on the first substrate 10.

Figure 5B:
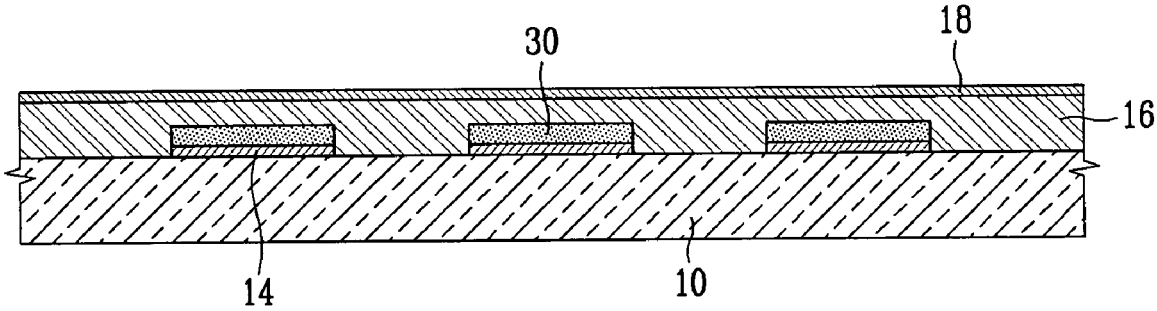

Referring to FIG. 5B, a conductive layer may be deposited on the insulating layer 16 and the gate electrodes 18 may be formed by patterning the conductive layer such that the gate electrodes 18 intersect the cathode electrodes 14, e.g., at right angles.

Figure 5C:
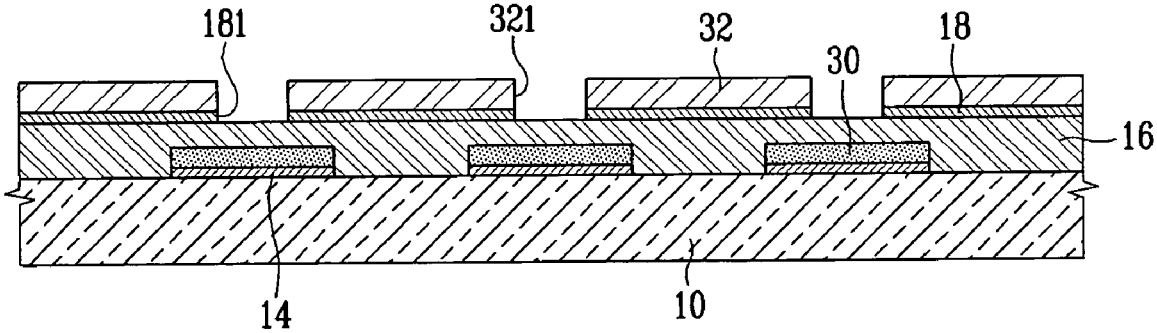

Referring to FIG. 5C, a mask layer 32 may be formed on the first substrate 10 to cover the gate electrodes 18 and the mask layer 32 may be selectively removed to provide openings 321 at locations where the sacrificial layer 30 is formed.

A width of each opening 321 of the mask layer 32 may be less than the width of the corresponding sacrificial layer 30 and cathode electrode 14. Portions of the gate electrodes 18, which may be exposed by the openings 321 of the mask layer 32, may be removed e.g., by etching, to form openings 181 in the gate electrodes 18.

Figure 5D:
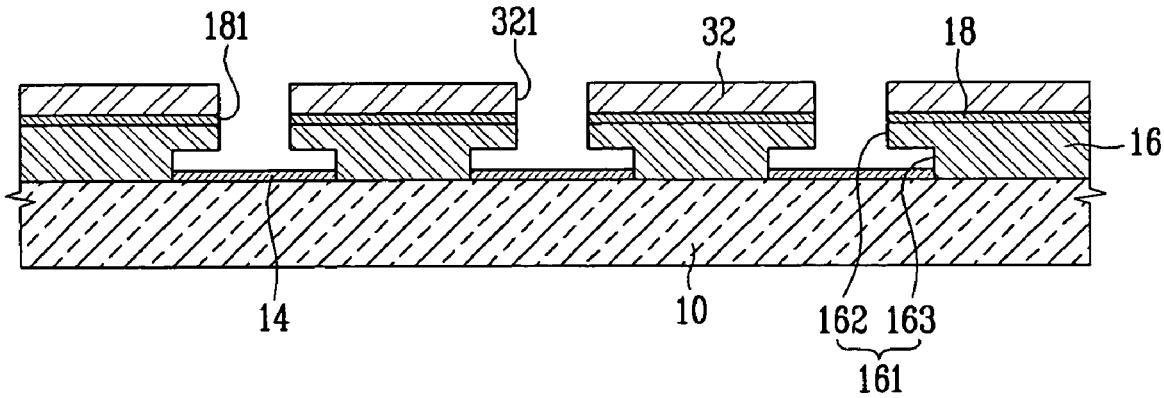

Referring to FIG. 5D, portions of the insulating layer 16 and portions of the sacrificial layers 30, which are exposed through the openings 181 of the gate electrodes 18, may be simultaneously etched. At this point, since the etching rate of the insulating layer 16 may be lower than the sacrificial layers 30, the insulating layer 16 may be etched only where it is exposed through the openings 181 while the sacrificial layers 30 are fully etched and removed.

Therefore, the insulating layer 16 may be provided with the upper opening portions 162 each having a width identical to that of the corresponding opening 181 of the gate electrodes 18 and the lower opening portions 163 each extending from the corresponding upper opening portion 162 downward and having a width greater than that of the corresponding upper opening portion 162.

Figure 5E:
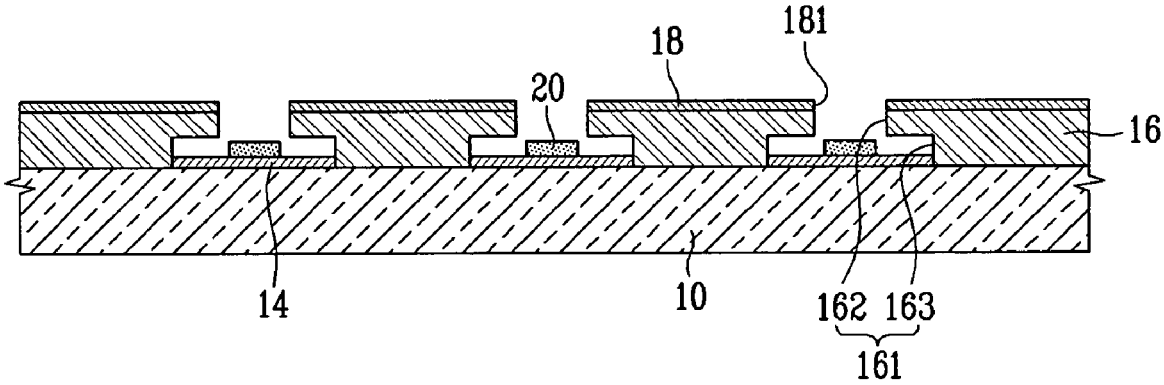

Next, the mask layer 32 may be removed, and as shown in FIG. 5E, the electron emission regions 20 may be formed on the cathode electrodes 14 inside the lower opening portions 163.

The electron emission regions 20 may be formed by preparing a paste mixture by mixing a powder material, e.g., carbon nanotubes, graphite, graphite nanofibers, diamonds, diamond-like carbon, $C_{60}$, silicon nanowires, or combinations thereof, with an organic material, e.g., a vehicle or binder. The paste mixture may be screen-printed the paste mixture on the exposed portions of the cathode electrodes 14, and the printed mixture may be dried and fired. Alternatively, a photosensitive material may be added to the paste mixture, which is then screen-printed on the first substrate 10. Then, an exposing mask may be disposed, e.g., on a rear surface of the first substrate 10, ultraviolet light may be irradiated through the exposing mask to harden predetermined regions of the printed material, regions that are not hardened may be removed, and the hardened regions may then dried and fired.

When using the photosensitive material, the first substrate 10 may be formed of a transparent material and the cathode electrodes 14 may be formed of a transparent conductive material, such as ITO. When the electron emission regions 20 are formed through the light exposure process, since the hardening of the printed mixture progresses from surfaces of the cathode electrodes 14, the adhesive force between the electron emission regions 20 and the cathode electrodes 14 may be enhanced, and the contact resistance between the cathode electrodes 14 and the electron emission regions 20 may be lowered.

Alternatively, the electron emission regions 20 can be formed, e.g., through a chemical vapor deposition process, a direct growth process, or a sputtering process.

In the above-described process of manufacturing the electron emission device, when only one sacrificial layer 30 and only one electron emission region 20 are formed at each crossed region of the cathode and gate electrodes 14 and 18, the electron emission device of FIG. 3 is realized. When at least two sacrificial layers 30 and at least two electron emission regions 20 are formed at each crossed region of the cathode and gate electrodes, the electron emission device of FIG. 1 is realized.

FIGS. 6A through 6E are partial sectional views of another process of manufacturing the electron emission devices of FIGS. 1 and 3.

Figure 6A:
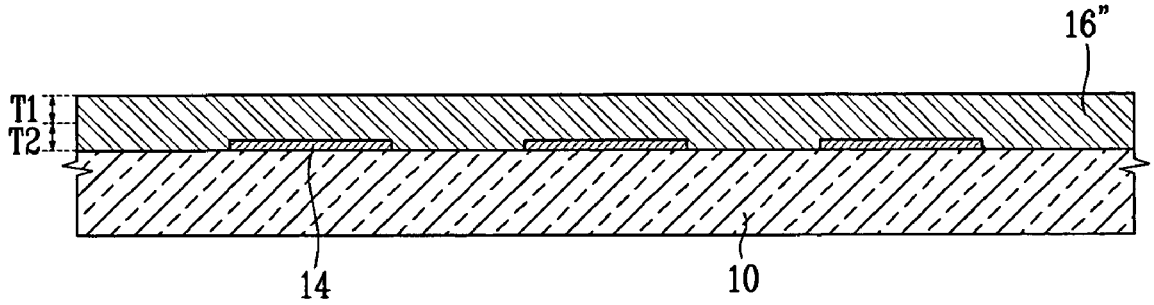
FIGS. 6A through 6E illustrate cross-sectional views of stages in another method of manufacturing the electron emission devices of FIGS. 1 and 3.

Referring first to FIG. 6A, a conductive layer may be formed on the first substrate 10 and the cathode electrodes 14 may be formed by patterning the conductive layer. An insulating layer 16" may be formed on the first substrate 10 to fully cover the cathode electrodes 14. The insulating layer 16" can be formed using, e.g., a plasma enhanced chemical vapor deposition (PECVD) process.

Figure 6B:
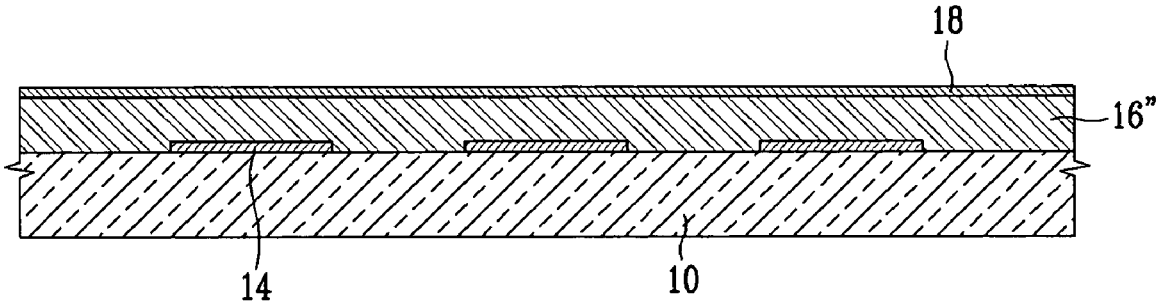

Referring to FIG. 6B, a conductive layer may be formed on the insulating layer 16" and the gate electrodes 18 crossing the cathode electrodes 14 at right angles may be formed by patterning the conductive layer.

Figure 6C:
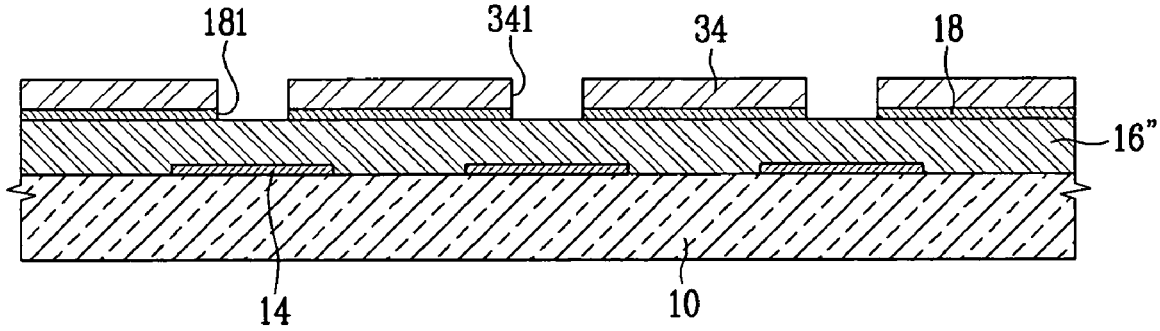

Referring to FIG. 6C, a mask layer 34 may be formed on the first substrate 10 to fully cover the gate electrodes 18 and openings 341 may be formed at locations where the electron emission regions will be formed by patterning the mask layer 34. Portions of the gate electrodes 18, which are exposed by the openings 341 of the mask layer 34, may be removed to form openings 181 through the gate electrodes 18.

When the insulating layer has differing characteristics, e.g., densities throughout, insulating layer 16" may be divided into an upper portion having a thickness T1 and a lower portion having a thickness T2 for purpose of the descriptive convenience, the insulating layer 16" may be formed such that. Such a difference in densities may be realized by altering the PECVD conditions, e.g., by setting a deposition temperature of the upper portion to be different from that of the lower portion.

For example, the deposition temperature of the upper portion may be higher than that of the lower portion. As a result, the lower portion of the insulating layer 16" may be more porous than the upper portion. That is, the density of the upper portion may be higher than that of the lower portion. Therefore, the etching rate of the upper portion may be lower than that of the lower portion when the upper and lower portions are etched by an particular etching solution.

For example, the insulating layer 16" may be formed with a thickness above about 3 μm as the deposition temperature gradually increases within a range of about 200-350° C.

Figure 6D:
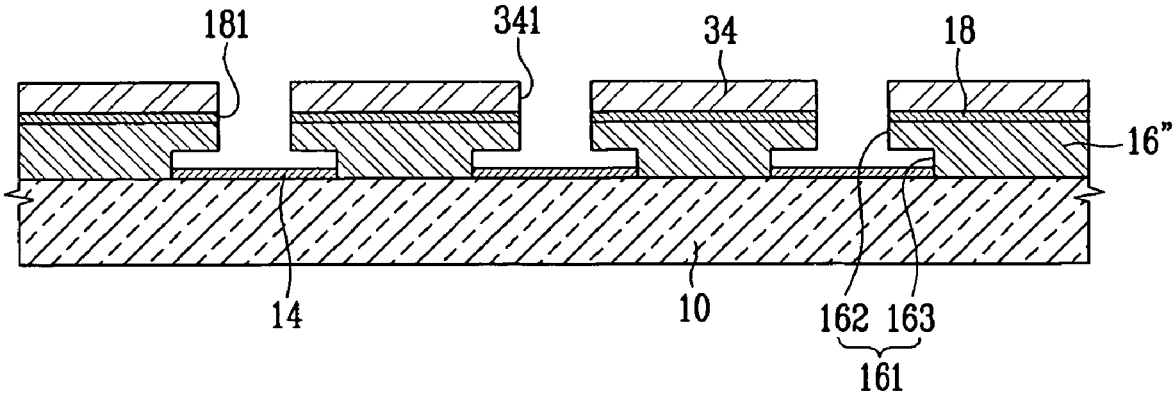

Referring to FIG. 6D, portions of the insulating layer 16", which are exposed by the openings 181 of the gate electrodes 18, may be etched. The etching of the upper portion of the insulating layer 16" having the density higher than that of the lower portion of the insulating layer 16" may progress more slowly than the etching of the lower, less dense portion of the insulating layer 16". As a result, the upper portion of the insulating layer 16" may be provided with the upper opening portions 181 each having a width identical to the corresponding opening 181 of the gate electrode 18 and the lower portion of the insulating layer 16" may be provided with lower opening portions 163 each having a width greater than the corresponding upper opening portion 162.

Figure 6E:
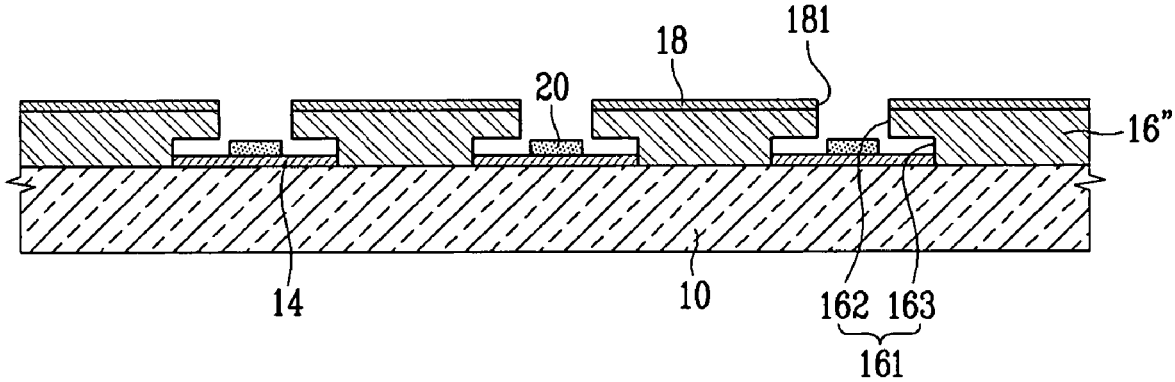

Then, the mask layer 34 may be removed, and, as shown in FIG. 6E, the electron emission regions 20 may be formed on the cathode electrodes 14 inside the lower opening portions 163. The remaining steps for completing the electron emission device may be performed in accordance with the foregoing process.

In the above-described method of manufacturing the electron emission device, when only one opening 181 and only one electron emission region 20 are formed at each crossed region of the cathode and gate electrodes 14 and 18, the electron emission device of FIG. 3 is realized. When at least two openings 181 and at least two electron emission regions 20 are formed at each crossed region of the cathode and gate electrodes 14 and 18, the electron emission device of FIG. 1 is realized.

Figure 7:
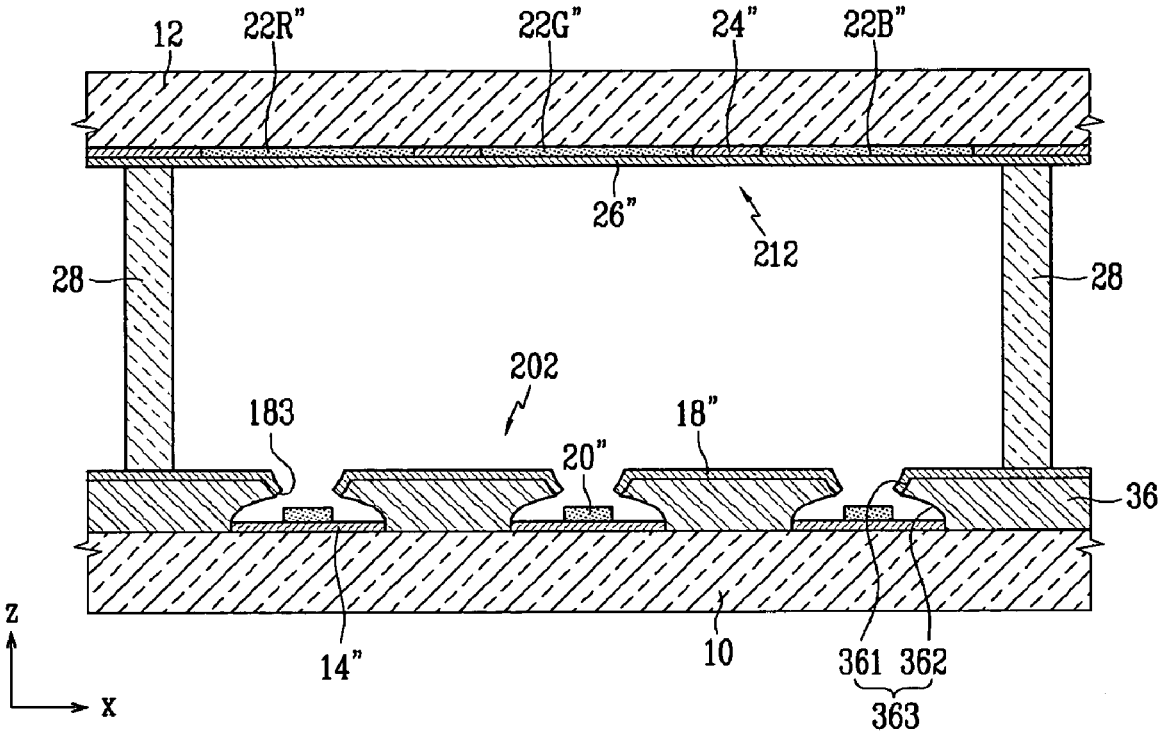
FIG. 7 illustrates a partial cross-sectional view of an electron emission device according to another embodiment of the present invention.

FIG. 7 illustrates a partial sectional view of an electron emission display according to another embodiment of the present invention.

In this embodiment, an insulating layer 36 may have upper opening portions 361 and lower opening portions 362 extending from the corresponding upper opening portions 361. The upper opening portions 361 may vary in their width in a vertical direction. The lower opening portions 362 also vary in their width in the vertical direction. Gate electrodes 18" may be formed on the insulating layer 36 as well as on inner walls of the upper opening portions 361.

In this embodiment, the width of each upper opening portion 361 gradually decreases toward the first substrate 10 while the width of each lower opening portion 362 gradually increases toward the first substrate 10. A width of the lowest portion of each lower opening portions 362 may be equal to or greater than that of the corresponding cathode electrode 14".

One or more openings 363 may be formed on the insulating layer 36 at the crossed regions of the cathode and gate electrodes 14" and 18".

The structures of the upper opening portions 361 may allow for stably forming the gate electrodes 18" on the inner walls of the upper opening portions 361. Since the gate electrodes 18" are formed on the inner walls of the upper opening portions 361, the distance between the electron emission regions 20" and the gate electrodes 18" can be effectively reduced. Therefore, an enhanced electric field that can be formed around the electron emission regions 20", thereby increasing an amount of electrons emitted from the electron emission regions 20".

FIGS. 8A through 8E illustrate cross-sectional views of stages of a process of manufacturing the electron emission device of FIG. 7.

Figure 8A:
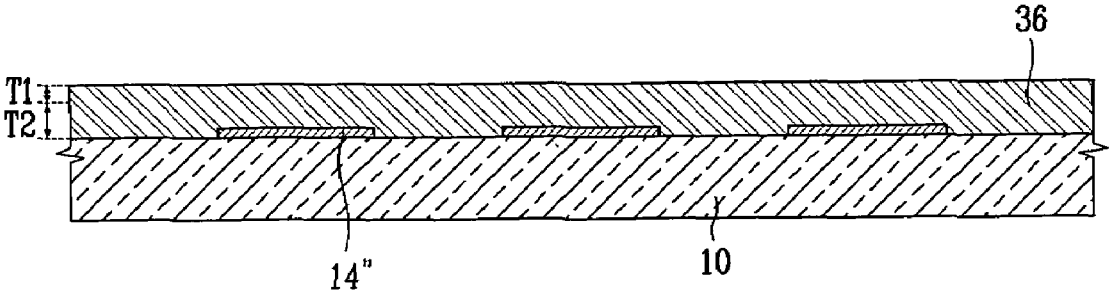
FIGS. 8A through 8E illustrate cross-sectional views of stages in a method of manufacturing the electron emission device of FIG. 7.

Referring to FIG. 8A, a conductive layer may be formed on the first substrate 10 and the cathode electrodes 14" may be formed by patterning the conductive layer. The insulating layer 36 may be formed on the first substrate 10 to fully cover the cathode electrodes 14". The insulating layer 36 can be formed through, e.g., a PECVD process. Similar to the process discussed in connection with FIG. 6A, the insulating layer 36 may be divided into an upper portion having a thickness T1 and a lower portion having a thickness T2 for purpose of the descriptive convenience. The upper portion may have a density higher than that of the lower portion by changing a deposition temperature of the upper portion from that of the lower portion, as discussed above.

Figure 8B:
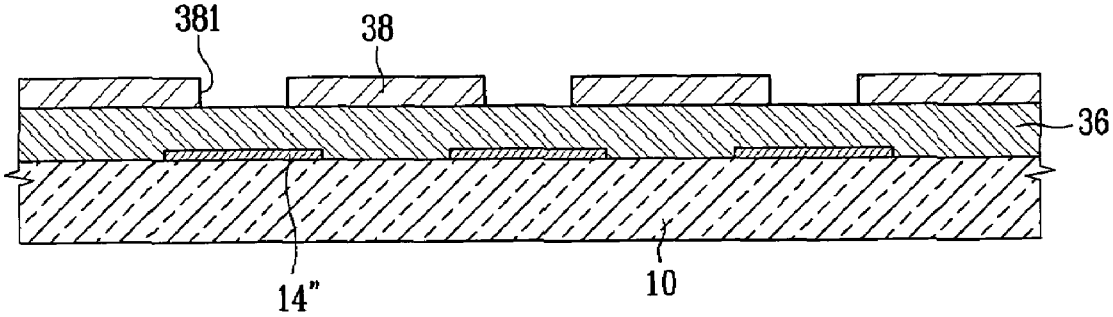

Referring to FIG. 8B, a mask layer 38 may be formed on the insulating layer 36 and openings 381 may be formed at locations where the electron emission regions will be formed by patterning the mask layer 38.

Figure 8C:
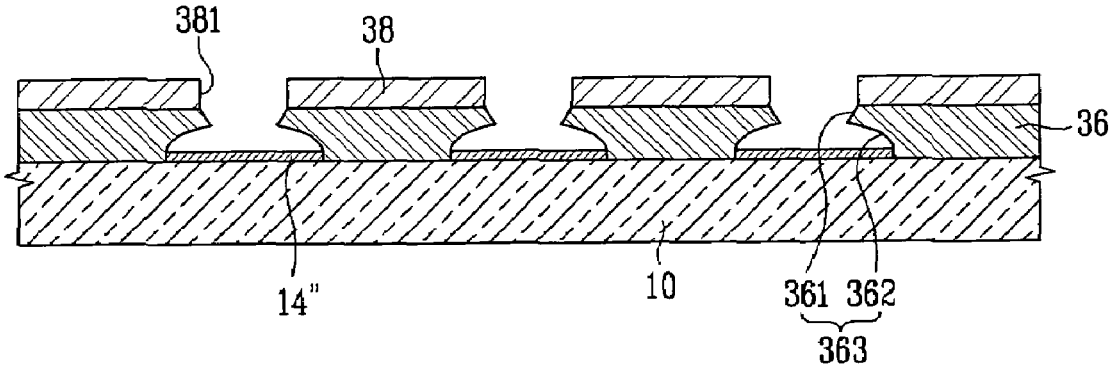

Referring to FIG. 8C, portions of the insulating layer 36, which are exposed by the openings 381 of the mask layer 38, may be removed by wet-etching to form openings 363 through the insulating layer 36.

At this point, since the etching of the upper portion T1 of the insulating layer 36 having the density higher than that of the lower portion T2 of the insulating layer 36 may progress slower than the etching of the less dense lower portion of the insulating layer 36, the upper portion T1 of the insulating layer 36 is provided with the upper opening portions 361, and the lower portion of the insulating layer 36 is provided with lower opening portions 362 each having a width greater than the corresponding upper opening portion 361.

Due to the isotropic etching property of the wet etching, the width of the upper opening portions 361 gradually decreases toward the first substrate 10 in the thickness T1, while the width of the lower opening portions 362 gradually increases toward the first substrate 10 in the thickness T2.

Figure 8D:
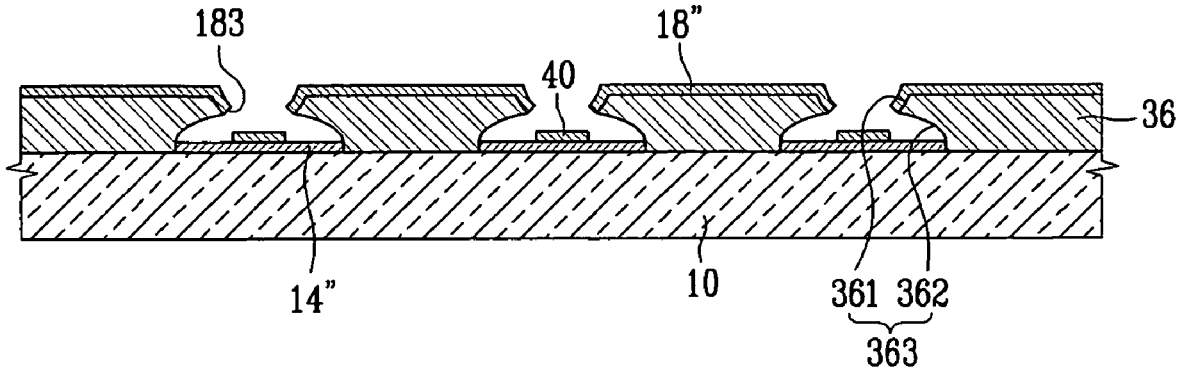

Then, the mask layer 38 may be removed, and as shown in FIG. 8D, a conductive layer may be formed on the insulating layer 36 and the gate electrodes 18" crossing the cathode electrodes 14" at right angles may be formed by patterning the conductive layer. The gate electrodes 18" may be formed on a top surface of the insulating layer 36 and inner walls of the upper opening portions 361.

In forming gate electrodes 18", the conductive layer for the gate electrodes 18" may be deposited on the cathode electrodes 14". At this point, since the width of the lower opening portions 362 is greater than the upper opening portion 361, the conductive layer 40 may be separated from the gate electrodes 18" and may serve as a part of the cathode electrodes 14". When the gate electrodes 18" are formed on the insulating layer 36 after the openings 363 are formed on the insulating layer 36, there is no need for a separate process for forming the openings 183 on the gate electrodes 18".

Figure 8E:
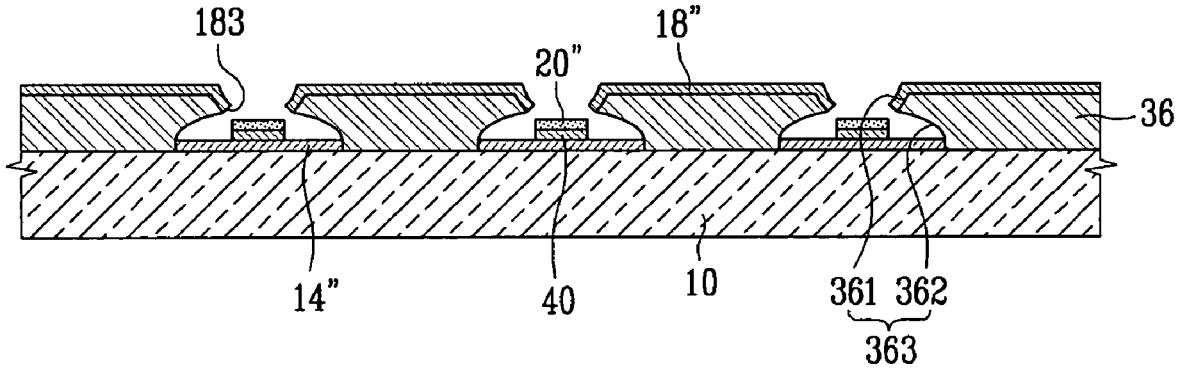

Referring to FIG. 8E, the electron emission regions 20" are formed on the cathode electrodes 14" inside the lower opening portions 362. The remaining steps for realizing the electron emission device can be performed in accordance with the foregoing process.

According to this embodiment, it is possible to reduce the distance between the electron emission regions 20" and the gate electrodes 18" without reducing the thickness of the insulating layer 36. As a result, the emission property of the electron emission regions 20" can be improved.

The above-described electron emission devices may include an additional insulating layer (not shown) and focusing electrodes above the first substrate to cover the gate electrodes. The additional insulating layer and the focusing electrodes can be provided with openings corresponding to the electron emission regions or corresponding to the crossed regions of the cathode and gate electrodes. The focusing electrodes serve to converge electrons passing through openings thereof by receiving 0V or a negative direct current voltage of several to tens volts.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission device, comprising:

a substrate;

a plurality of cathode electrodes formed on the substrate;

a plurality of electron emission regions electrically coupled to the cathode electrodes;

an insulating layer formed on the substrate and covering the cathode electrodes; and a plurality of gate electrodes formed on the insulating layer and crossing the cathode electrodes, wherein the insulating layer includes a plurality of openings exposing corresponding electron emission regions, each opening having at least two opening portions in communication with each other and having different sizes from each other, widths at an interface between adjacent opening portions being discontinuous, and each opening including an upper opening portion having a first width and a lower opening portion having a second width, the second width being greater than the first width, and the gate electrodes include openings in communication with corresponding openings of the insulating layer.

2. The electron emission device as claimed in claim 1, wherein the second width is equal to or greater than a width of the cathode electrode.

3. The electron emission device as claimed in claim 1, wherein an area of the lower opening portion is equal to or greater than an area of a crossing region of the gate and cathode electrodes.

4. The electron emission device as claimed in claim 1, wherein the gate electrodes extend to inner walls of the upper opening portions.

5. The electron emission device as claimed in claim 1, wherein a width of the upper opening portion gradually decreases toward the substrate, and a width of the lower opening portion gradually increases toward the substrate.

6. The electron emission device as claimed in claim 1, wherein the insulating layer includes a first layer having the upper opening portion and a second layer having the lower opening portion, the first layer having a higher density than the second layer.

7. The electron emission device as claimed in claim 1, wherein the at least two opening portions have linear sidewalls.

8. A method of manufacturing an electron emission device, comprising:

forming a plurality of cathode electrodes on a substrate;

forming an insulating layer on the substrate;

forming a plurality of openings in the insulating layer, each opening of the insulating layer having upper and lower opening portions in communication with each other and having different sizes from each other, widths at an interface between upper and lower opening portions being discontinuous, and the upper opening portion having a first width and the lower opening portion having a second width, the second width being greater than the first width;

forming a plurality of gate electrodes on the insulating layer, the gate electrodes having openings communicating with corresponding opening of the insulating layer; and forming a plurality of electron emission regions on the cathode electrodes inside the lower opening portions of the insulating layer.

9. The method as claimed in claim 8, wherein forming the plurality of gate electrodes is performed before forming the plurality of opening in the insulating layer, the method further comprising:

forming a plurality of openings in the gate electrode; and sequentially etching the insulating layer through the openings of the gate electrode.

10. The method as claimed in claim 9, further comprising, before forming the insulating layer, forming a sacrificial layer on each cathode electrode, wherein the sacrificial layer has an etching rate higher than that of the insulating layer, each opening on the gate electrode has a width less than a width of the sacrificial layer, and each opening of the insulating layer being formed by sequentially etching the insulating layer and the sacrificial layer through the openings of the gate electrodes.

11. The method as claimed in claim 10, wherein a width of the sacrificial layer is equal to or greater than a width of the corresponding cathode electrode.

12. The method as claimed in claim 9, wherein the upper opening portion having a higher density than the lower opening portion.

13. The method as claimed in claim 12, wherein forming the insulating layer includes depositing the insulating material and increasing a deposition temperature used during forming of the upper opening portion from that during forming of the lower opening portion.

14. The method as claimed in claim 8, further comprising:

providing a mask layer having a plurality of openings on the insulating layer, wherein forming the plurality of openings in the insulating layer includes etching the insulating layer through the openings of the mask layer, and forming the plurality of gate electrodes includes forming gate electrodes on a top surface of the insulating layer and inner walls of the upper opening portion.

15. The method as claimed in claim 14, wherein the upper opening portion having a higher density than the lower opening portion.

16. The method as claimed in claim 15, wherein forming the insulating layer includes depositing the insulating material and increasing a deposition temperature during forming of the upper opening portion from that during forming of the lower opening portion.

17. The method as claimed in claim 8, wherein forming the upper and lower opening portions includes forming the insulating layer such that the width of the upper opening portion gradually decreases toward the substrate and the width of the lower opening portion gradually increases toward the substrate.

18. The method as claimed in claim 8, wherein forming the upper and lower opening portions includes forming the at least two opening portions to have linear sidewalls.

19. An electron emission display, comprising:

first and second substrates facing each other and spaced apart from each other;

a plurality of cathode electrodes formed on the first substrate;

a plurality of electron emission regions electrically coupled to the cathode electrodes;

an insulating layer formed on the first substrate and covering the cathode electrodes;

a plurality of gate electrodes formed on the insulating layer and crossing the cathode electrodes, a plurality of phosphor layers formed on the second substrate; and an anode electrode formed on one surface of the phosphor layers, wherein the insulating layer includes a plurality of openings exposing corresponding electron emission regions, each opening having at least two opening portions in communication with each other and having different sizes from each other, widths at an interface between adjacent opening portions being discontinuous, and each opening including an upper opening portion having a first width and a lower opening portion having a second width, the second width being greater than the first width, and the gate electrodes include openings in communication with corresponding openings of the insulating layer.

20. The electron emission display as claimed in claim 19, wherein a width of the upper opening portion gradually decreases toward the substrate, and a width of the lower opening portion gradually increases toward the substrate.

21. The electron emission display as claimed in claim 19, wherein the gate electrodes extend to inner walls of the upper opening portion.

22. The electron emission display as claimed in claim 19, wherein the at least two opening portions have linear sidewalls.

23. The electron emission display as claimed in claim 19, wherein the second width is equal to or greater than a width of the cathode electrode.

24. The electron emission display as claimed in claim 19, wherein an area of the lower opening portion is equal to or greater than an area of a crossing region of the gate and cathode electrodes.

25. The electron emission display as claimed in claim 19, wherein the insulating layer includes a first layer having the upper opening portion and a second layer having the lower opening portion, the first layer having a higher density than the second layer.

* * * * *